US008920299B2

(12) United States Patent
Keller

(10) Patent No.: US 8,920,299 B2
(45) Date of Patent: Dec. 30, 2014

(54) MACHINE FOR THE MANUFACTURE OF PAPER CUSHIONS

(75) Inventor: Reinhard Keller, Bottighofen (CH)

(73) Assignee: Pack-Tiger GmbH, Daettlikon (CH)

( * ) Notice: Subject to any disclaimer, the term of this patent is extended or adjusted under 35 U.S.C. 154(b) by 1289 days.

(21) Appl. No.: 12/516,556

(22) PCT Filed: Sep. 27, 2007

(86) PCT No.: PCT/EP2007/008426

§ 371 (c)(1),
(2), (4) Date: Aug. 10, 2010

(87) PCT Pub. No.: WO2008/074372

PCT Pub. Date: Jun. 26, 2008

(65) Prior Publication Data

US 2010/0300639 A1 Dec. 2, 2010

(30) Foreign Application Priority Data

Dec. 18, 2006 (DE) ..... 10 2006 059 638

(51) Int. Cl.
*B31D 5/00* (2006.01)

(52) U.S. Cl.
CPC ..... *B31D 5/0043* (2013.01); *B31D 2205/0023* (2013.01); *Y10S 493/967* (2013.01)
USPC ..... 493/464; 493/475; 493/967

(58) Field of Classification Search
CPC .. B31D 5/0039; B31D 5/0043; B31D 5/0047; B31D 5/0052; B31D 2205/0005; B31D 2205/0023; B31D 2205/0047
USPC ..... 493/464, 475, 967
See application file for complete search history.

(56) References Cited

U.S. PATENT DOCUMENTS

| | | | | |
|---|---|---|---|---|
| 3,603,216 | A * | 9/1971 | Johnson | 493/359 |
| 4,717,613 | A * | 1/1988 | Ottaviano | 493/967 |
| 5,755,656 | A * | 5/1998 | Beierlorzer | 493/464 |
| 6,120,428 | A * | 9/2000 | Ratzel | 493/464 |
| 6,190,299 | B1 * | 2/2001 | Simmons | 493/464 |
| 6,421,985 | B1 * | 7/2002 | Simmons, Jr. et al. | 493/967 |
| 6,758,801 | B2 * | 7/2004 | Harding et al. | 493/464 |
| 8,167,783 | B2 * | 5/2012 | Keller | 493/464 |
| 2005/0020427 | A1 | 1/2005 | Ratzel et al. | |

FOREIGN PATENT DOCUMENTS

| | | | |
|---|---|---|---|
| EP | 0 679 504 | A1 | 11/1995 |
| EP | 1 197 321 | A1 | 4/2002 |
| EP | 1 645 406 | A | 4/2006 |
| WO | WO 99/04963 | A1 | 2/1999 |

(Continued)

*Primary Examiner* — Stephen F Gerrity
(74) *Attorney, Agent, or Firm* — Kilpatrick Townsend & Stockton LLP

(57) ABSTRACT

The present invention relates to a device for the production of paper cushioning from a paper web (8) rolled up into a supply roll (12), wherein the device has a machine comprising a support device for the pivoted support of the supply roll, a reshaping device (22, 22', 22") for reshaping the paper web, and a device for the production of the paper cushioning. A bracket (30) that can be pivoted between a contact position and a releasing position is provided in a region in front of the paper web infeed into the reshaping device, wherein the bracket rests on the paper web in the contact position.

14 Claims, 2 Drawing Sheets

(56) References Cited

FOREIGN PATENT DOCUMENTS

Figure 3:
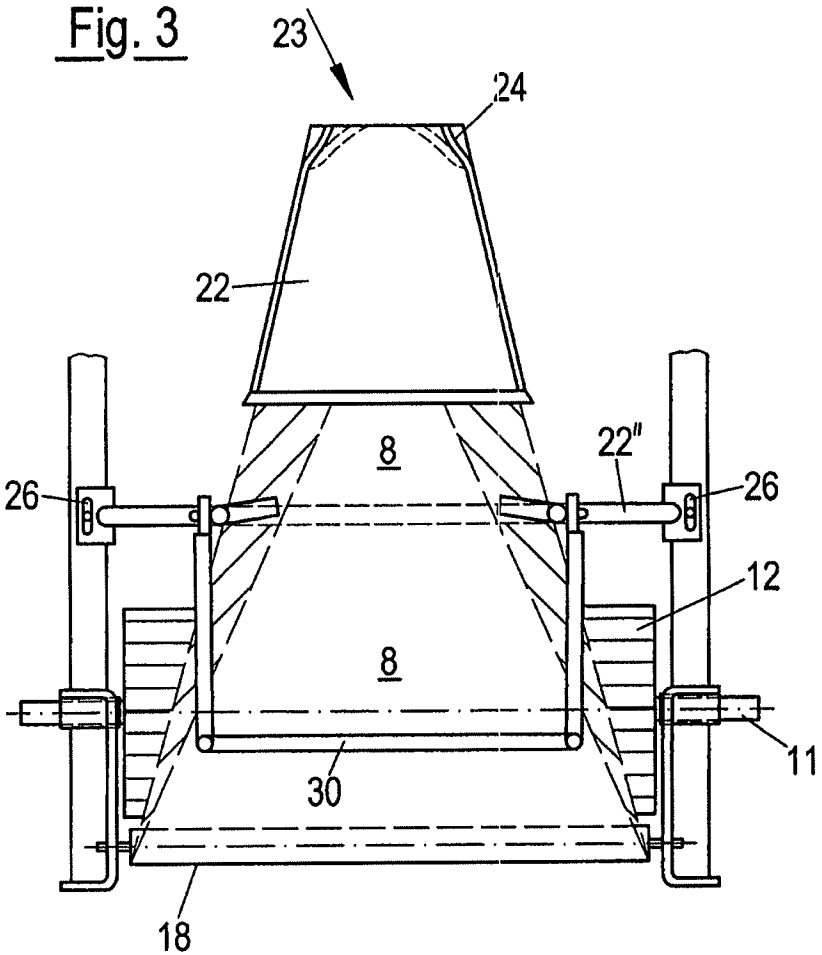

| | | | | | |
|---|---|---|---|---|---|
| WO | WO 00/07808 | A1 | | 2/2000 | |
| WO | WO 0198071 | A2 | * | 12/2001 | ..... B31D 5/0047 |
| WO | WO 2005/007394 | A2 | | 1/2005 | |
| WO | WO 2006/023900 | A2 | | 3/2006 | |

* cited by examiner

MACHINE FOR THE MANUFACTURE OF PAPER CUSHIONS

CROSS REFERENCE TO RELATED APPLICATIONS

This application is a National Stage of International Application No. PCT/EP2007/008426 filed Sep. 27, 2007 and which claims the benefit of German Patent Application No. 10 2006 059 638.2 filed Dec. 18, 2006, the disclosures of all applications being incorporated herein by reference.

The present invention relates to a machine for the manufacture of paper cushions from a paper web rolled up on a supply roll, with the machine having a shaping device to shape the paper web. Such a machine is known from WO-A-00/07808 and from EP 05 00 3407. The apparatus manufactures a paper cushion having good damping properties and a low density from the paper web rolled off the supply roll, said paper cushion in particular being able to be used for the packing of impact-sensitive articles.

It is the object of the invention to improve a machine of the initially named kind such that a problem-free manufacture of paper cushions of different formats is made possible even at high conveying speeds and on a stoppage during operation.

This object is satisfied by the features of claim 1 and in particular in that a hoop is provided in a region before the entry of the paper web into the shaping device which is pivotable between a pressing position and a release position and lies on the paper web in the pressing position.

This hoop contributes to the tightening of the paper web and provides a constant tension of the paper web even when the supply roll only has a comparatively small diameter. If the machine is stopped during operation, the paper web trails due to the inertia of the supply roll and the hoop also provides an optimum running direction and a constant tension in this case so that no tearing of the paper web occurs when the machine is restarted. In addition, the paper web is so-to-say straightened by the weight of the hoop lying on it, that is its angle of inclination with respect to the shaping device is reduced so that the entry into the shaping device is improved.

Advantageous embodiments of the invention are described in the description, in the claims and in the drawings.

In accordance with a first advantageous embodiment, a holder is provided to hold the hoop in its release position. Such a holder prevents the hoop from moving on its own due to gravity from the release position into the pressing position, which would impede the insertion of a supply roll into the machine.

In accordance with a further advantageous embodiment, the shaping device includes a paper guide which is adjustable in the conveying direction and at which the hoop is pivotably supported. The adjustability of the paper guide permits a regulation of the width of the paper cushion to be manufactured. When the hoop is supported at this adjustable paper guide, its position is likewise automatically adapted to the desired width of the paper cushion.

The shaping device advantageously includes a shaping hoop adjustable in the conveying direction. Such a shaping hoop can support the rolling in of the paper web. The adjustability likewise provides the possibility of regulating the width of the paper cushion to be manufactured.

In accordance with a further advantageous embodiment of the invention, the hoop is adjustably supported in the conveying direction. This can be realized, as already mentioned above, either in that the hoop is supported at an element of the shaping device adjustable in the conveying direction.

The hoop can, however, naturally also be adjustably supported at a rack of the machine independently of the shaping device. In both cases, an influencing of the width of the paper cushion to be manufactured is made possible by the adjustability of the hoop.

In accordance with a preferred embodiment of the invention, the machine has at least one deflection roll, whose width is lower than the width of the paper web, for the guidance of the paper web. A tearing of the paper web is thereby prevented, in particular on the start-up of the machine, even if the paper web is not ideally tensioned.

At least one deflection roll is preferably provided whose shaft is in particular movably supported against the force of a spring in elongate holes. A support of the deflection rolls in elongate holes is admittedly already known from WO 00/07808, but in this prior art the deflection rolls, which can also have a guide function, only load the paper web due to their own weight. However, a spring is additionally provided in accordance with the invention which biases the deflection roll in the elongate holes. In this manner, the machine can also be started without jolting and softly if a very heavy supply roll is provided.

In accordance with a preferred embodiment of the invention, the shaping device includes a funnel-like chute tapering in the conveying direction, with the size of the initial opening of the chute being adjustable. Pivotal wall regions of the chute can serve for the adjustment of the size of the initial opening, for example. If they are pivoted inwardly, the initial opening of the chute is reduced in size so that smaller paper cushions are produced.

The present invention can be used universally and permits operation both at low processing speeds and at high processing speeds and with different types of paper. Very hard and stiff papers as well as soft papers can thus be used with the machine in accordance with the invention. The machine is very particularly suitable for heavy supply rolls, high processing speeds and papers with low tear strength. The cushions to be manufactured with the machine in accordance with the invention can be individual cushions or also endless cushions.

Figure 1:
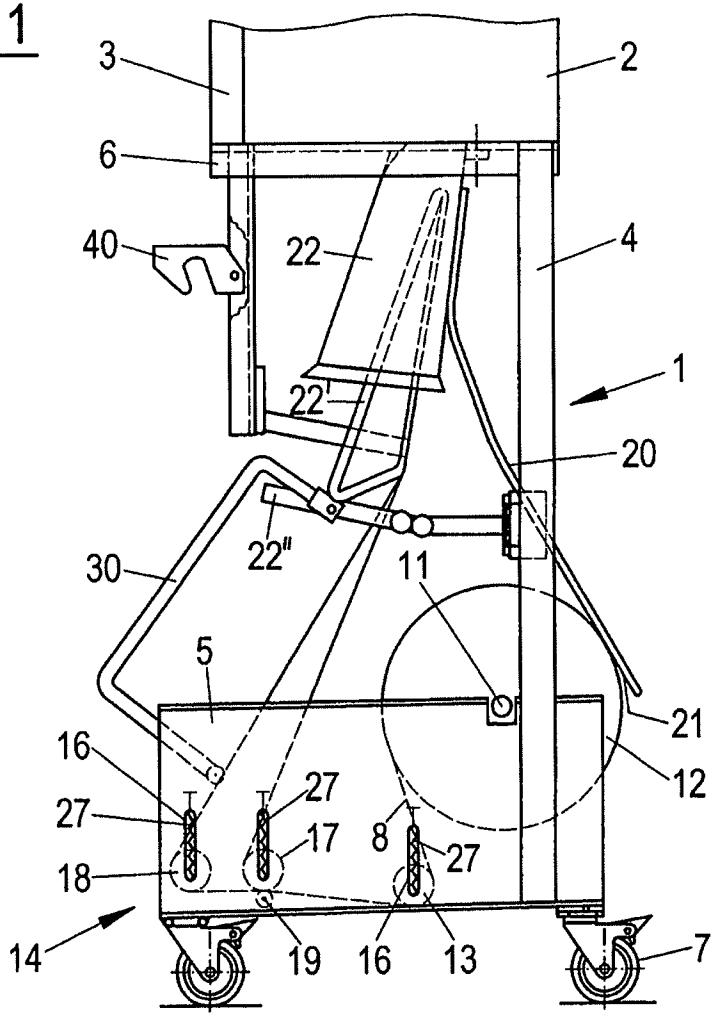
Figure 2:
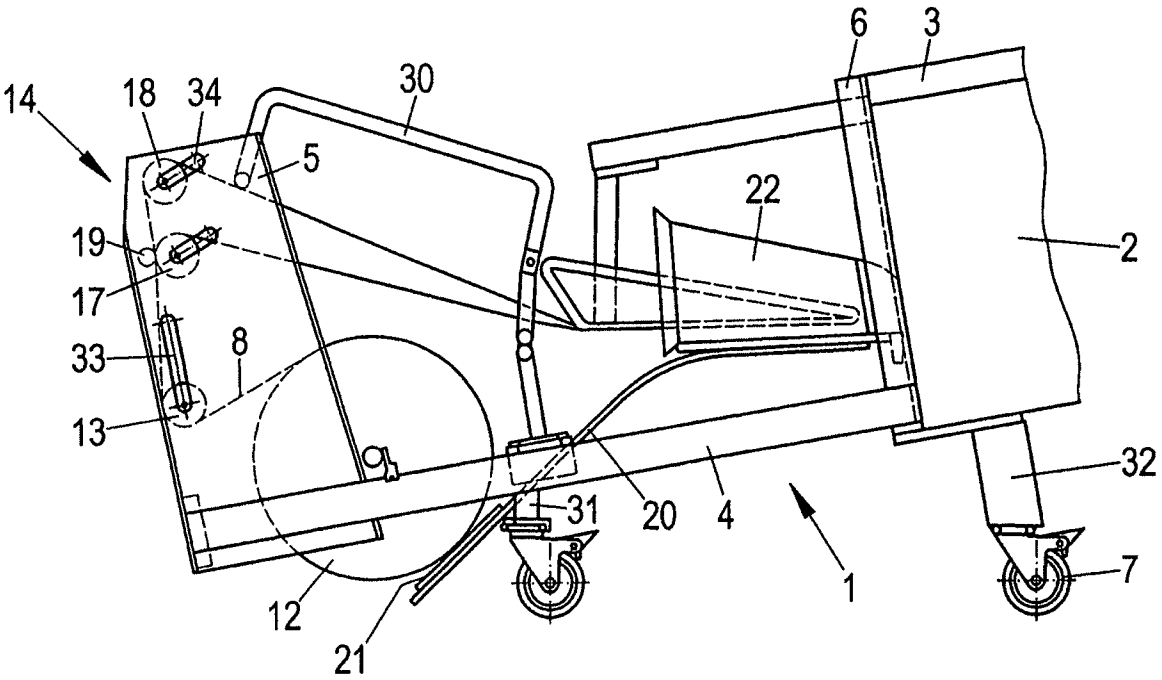

The present invention will be described in the following purely by way of example with reference to advantageous embodiments and to the enclosed drawings. There are shown:

FIG. 1: a schematic representation of a machine for the manufacture of paper cushions;

FIG. 2: a schematic representation of a machine for the manufacture of paper cushions; and FIG. 3 a schematic representation of the machine from FIG. 1 from a different perspective.

FIG. 1 shows a machine for the manufacture of cushion-like material or of paper cushions, with the machine being divided into a rack 1 and a housing 2. A drive provided with a motor is located in the housing 2 provided with a control panel 3 to pull a paper web 8 through a shaping device 22, 22' and 22" and to shape a cushion out of the paper web.

The rack 1 substantially consists of a frame 4, two side parts 5, which are formed as shield supports and are fastened standing freely to the rack, and a carrier 6. A plurality of wheels 7 are provided at the rack 1 to move the machine.

An arrangement to supply the paper web 8 is installed in the rack 1. The arrangement includes a shaft 11 for a supply roll 12 having a paper web consisting of two paper plies. Furthermore, two deflection rolls 13, 17 and 18 are provided which are parallel to one another, with the deflection rolls 17 and 18 forming a separation device 14 to separate the paper plies. The shaft 11 of the supply roll 12 is supported at the side parts 5 of the rack. The deflection rolls 13, 17 and 18 are each supported with their shafts in an elongate hole 16 which is arranged substantially vertically in each side part 5. The separation device 14 includes the deflection roll 17, which is in contact with the paper web 8 and serves to raise and deflect a paper ply, as well as the second deflection roll 18 which is designed to deflect the second paper ply. Furthermore, a further roll 19 is supported in bores which are formed in the side parts 5. The first deflection roll 17 lies on the roll 19 with the paper web 8 as an intermediate layer. The deflection rolls 17, 18 of the separation device 14 have a lower width than the paper web 8. In the embodiment shown in FIG. 1, the paper web 8 has a width of 74.0 cm, whereas the deflection rolls 17, 18 only have a width of 71.5 cm. A tearing of the paper web 8 is thereby prevented in particular on a restart of the machine after an interruption to production.

As FIG. 1 further shows, the shafts of the deflection rolls 13, 17 and 18 are movable within the elongate holes against the force of springs 27.

A brake liner 21 of a brake band 20 consisting of spring steel contacts the outer periphery of the supply roll 12.

The shaping device 22, 22', 22" includes a paper guide 22" which effects a rolling in of the paper web at its outer marginal regions. This paper guide 22" is, as FIG. 3 shows, supported vertically adjustably in elongate holes 26 at the frame 4. This vertical adjustability permits an adaptation to the desired width of the paper cushion. The higher the paper guide 22" is pushed upwardly in the elongate holes 26, the wider the manufactured paper cushion becomes.

A shaping hoop 22' is provided above the paper guide 22"; it is likewise a component of the shaping device 22, 22', 22" and supports the rolling in of the paper web 8. The shaping hoop 22' is vertically adjustably supported at the carrier 6, but also be made stationary. A funnel-like chute 22 is provided for the introduction of the paper plies into the housing 2 and has a converging section with curved wall sections 24 at the narrow side. As can be recognized in FIG. 3, the curved wall sections 24 are pivotable to adjust the width of the paper cushions leaving the chute 22. Narrower paper cushions are manufactured with inwardly pivoted wall sections 24, whereas wider paper cushions are obtained by an outward pivoting of the wall sections 24. Together with the vertical adjustability of the paper guide 22" and of the shaping hoop 22', described above the adjustable wall sections 24 permit a stepless setting of the width of the paper cushions to be manufactured over a large range.

A hoop 30 is pivotably supported at the paper guide 22" and is shown in a pressing position in the Figures. As can in particular be recognized in FIG. 2, the hoop 30 lies on the paper web 8 over its total width in this pressing position. The hoop 30 thus supports the tension of the outer paper ply of the paper web 8 achieved by the resiliently supported deflection roll 18, as will be described in more detail below. A holder 40, which has a recess for the reception of the hoop 30, is provided at the carrier 6 at the level of the funnel-shaped chute 22. The hoop 30 can be pivoted out of its pressing position shown in the Figures into a release position in which it is then held by the holder 40.

The hoop 30 is first pivoted into its release position and latched into the holder 40 to prepare for operation. As already mentioned, the shield supports 5 are fastened to the rack 1 in a free standing manner so that the deflection rolls 13, 17 and 18 and the roll 19 are freely accessible when the hoop 30 is in its release position and a supply roll 12 can be inserted into the rack 1. The supply roll 12 provided with the shaft 11 is rolled, as shown in FIG. 1, onto a cut-out provided for the support of the shaft 11. In this position, the supply roll 12 comes into contact with the brake band 20 so that an unwanted unwinding of the paper web is prevented. The paper web 8 is subsequently introduced between the deflection roll 17 and the roll 19 via the deflection roll 13. The two paper plies of the paper web 8 are separated at the deflection rolls 17 and 18. Subsequently, the ends of the paper plies are introduced into the chute 22. Not only the chute 22 serves for the shaping of the paper web in this process, but also the shaping hoop 22' and the paper guide 22" which effect a lateral rolling in of the paper web in joint cooperation with the chute 22. The hoop 30 is pivoted into its pressing position before the machine is put into operation so that the outer paper ply of the paper web 8 running over the deflection roll 18 is pressed and additionally tightened by the weight of the hoop 30 in the direction of the inner paper ply running over the deflection roll 17.

The manner of function of the previously described machine will be explained in the following.

During operation, the deflection roll 13 lies on the paper web 8 with its own weight to hold the paper web under tension. The deflection rolls 17 and 18 likewise lie on the paper web 8 with their own weight to tension the individual paper plies, on the one hand, and to ensure a uniform supply of the paper plies, on the other hand. The hoop 30 lies on the outer paper ply with its own weight and presses it in the direction of the inner paper ply. The angle of inclination of the outer paper ply is thereby reduced so that the introduction of the paper web 8 into the funnel-shaped chute 22 is improved. In addition, the outer ply of the paper web 8 is additionally tautened so that an optimum tension of the paper web is always provided even with an already greatly reduced diameter of the supply roll or after a stoppage of the machine. When the apparatus is started, the guide rolls 13, 17 and 18 can be raised in the elongate holes against the force of the springs 27 so that a problem-free start-up is possible even with a heavy supply roll 12. The problem-free start-up is in addition supported in that, as mentioned above, the width of the deflection rolls 17, 18 of the separation device 14 is selected to be smaller than the width of the paper web so that no tearing of the paper web 8 occurs even if the paper web 8 breaks out at the deflection roll 18. Such a breaking out of the paper web 8 can in particular occur when the supply roll 12 only has a comparatively small diameter or when the machine is stopped in operation and the paper web lags due to the inertia of the supply roll 12 without the paper being pulled into the shaping device 22, 22', 22". In these cases, however, it is prevented by the lower width of the deflection rolls 17, 18 and by the hoop 30 lying on that a paper bead forms at the outer deflection roll 18 which could result in a tearing of the paper web 8 on the restart of the machine.

FIG. 2 shows another embodiment of the machine in accordance with the invention which is made as a table model, but does not differ in function from the machine shown in FIG. 1 and described above. The machine likewise has a rack 1 with a frame 4 and side parts 5 for the support of the shaft 11 of the supply roll 12 as well as of the deflection rolls 13, 17, 18. The rack 1 is provided, as in the embodiment describe above, with wheels 7 which are here, however, mounted with holders 31, 32 so that the rack 1 is arranged inclined with respect to the horizontal The machine shown in FIG. 2 differs from the machine described above in the arrangement of the deflection rolls 13, 17, 18 in the side parts 5. The deflection roll 13 is supported in the side parts 5 in an elongate hole 33 which is made parallel to the lower edge of the rack 1. The elongate roll 33 can be made such that it is arranged vertically to the contact surface of the rack 1. The deflection rolls 17, 18 of the separation device 14 are supported in elongate holes 34 which are arranged inclined with respect to the frame 4. The roll 19 is supported in bores. The position of the elongate hole 34 for the support of the deflection roll 17 is selected with respect to the bore for the support of the roll 19 such that the deflection roll 17 contacts the roll 19 tangentially. The shaping device 22, 22', 22" corresponds to the shaping device described above for the machine shown in FIG. 1. As described above, a hoop 30 is also pivotably supported at the paper guide 22" in this embodiment and presses the outer paper ply running over the deflection roll 18 in the direction of the inner paper ply in the pressing position shown in FIG. 2. A holder for the hoop 30 is not shown in FIG. 2, since the hoop can be placed onto the carrier 6 in a release position. The deflection rolls 17, 18 of the separation device 14 are also somewhat narrower than the paper web 8 in this embodiment.

REFERENCE NUMERAL LIST

1 rack
2 housing
3 control panel
5 side part
6 carrier
7 wheels
8 paper web
11 shaft
12 supply roll
13 deflection roll
14 separation device
16 elongate hole
17 deflection roll
18 deflection roll
19 roll
20 brake band
21 brake liner
22 chute
22' shaping hoop
22" paper guide
23 exit opening
24 wall section
26 elongate hole
27 spring
30 hoop
31, 32 holder
33, 34 elongate hole

The invention claimed is:

1. A machine for the manufacture of paper cushions from a paper web rolled up on a supply roll, comprising:

a paper cushion forming device configured to shape the paper web to thereby manufacture the paper cushions from the paper web;

a hoop provided upstream in a conveying direction of the paper cushion forming device, wherein the hoop is freely pivotable between a pressing position and a release position, wherein the hoop is biased by gravity toward the pressing position, wherein, in the pressing position, the hoop is further biased by gravity to rest on the paper web with its own weight to thereby act as a tensioner on the paper web; and a holder configured to hold the hoop in the release position of the hoop.

2. A machine in accordance with claim 1, wherein the paper cushion forming device comprises a paper guide which is adjustable in the conveying direction and at which the hoop is pivotably supported.

3. A machine in accordance with claim 1, wherein the paper cushion forming device comprises a shaping hoop adjustable in the conveying direction.

4. A machine in accordance with claim 1, wherein the hoop is adjustably supported in the conveying direction.

5. A machine in accordance with claim 1, further comprising at least one deflection roll, wherein a width of the deflection roll is smaller than a width of the paper web, wherein the deflection roll is configured to guide the paper web.

6. A machine in accordance with claim 1, further comprising at least one deflection roll comprising a shaft, wherein the shaft is movably supported against the force of a spring.

7. A machine in accordance with claim 1, wherein the paper cushion forming device comprises a chute, tapering in the manner of a funnel in the conveying direction, wherein a size of an outlet opening of the chute is adjustable.

8. A machine for the manufacture of paper cushions from a paper web rolled up on a supply roll, comprising:

a paper cushion forming device configured to shape the paper web to thereby manufacture the paper cushions from the paper web;

a hoop provided in a region before the entry of the paper web into the shaping forming device which can be pivoted between a pressing position and a release position and which lies on the paper web in the pressing position; and a holder provided to hold the hoop in its release position.

9. The machine of claim 8, further comprising at least one deflection roll, whose width is smaller than the width of the paper web, for the guidance of the paper web.

10. The machine of claim 8, further comprising at least one deflection roll whose shaft is movably supported against the force of a spring.

11. The machine of claim 8, wherein the paper cushion forming device comprises a paper guide which is adjustable in a conveying direction and at which the hoop is pivotably supported.

12. The machine of claim 8, wherein the paper cushion forming device comprises a shaping hoop adjustable in a conveying direction.

13. The machine of claim 8, wherein the hoop is adjustably supported in a conveying direction.

14. The machine of claim 8, wherein the paper cushion forming device comprises a chute, tapering in the manner of a funnel in a conveying direction, wherein a size of an outlet opening of the chute is adjustable.

* * * * *